US008459493B2

(12) United States Patent
Suarez, Jr. et al.

(10) Patent No.: US 8,459,493 B2
(45) Date of Patent: Jun. 11, 2013

(54) BOWL AND CUP COMBINATION APPARATUS

(76) Inventors: Felix E. Suarez, Jr., Miami, FL (US); Felix E. Suarez, Sr., Hialeah, FL (US); Manuel J. Suarez, Hialeah, FL (US)

( * ) Notice: Subject to any disclaimer, the term of this patent is extended or adjusted under 35 U.S.C. 154(b) by 0 days.

(21) Appl. No.: 13/341,095

(22) Filed: Dec. 30, 2011

(65) Prior Publication Data

US 2012/0168325 A1 Jul. 5, 2012

Related U.S. Application Data

(60) Provisional application No. 61/460,297, filed on Dec. 30, 2010.

(51) Int. Cl.
*A47G 19/00* (2006.01)

(52) U.S. Cl.
USPC ..... 220/705; 220/711; 220/254.1; 220/23.83; 215/388; 206/217

(58) Field of Classification Search
USPC ..... 220/703, 705, 23.83, 23.86, 711, 220/241.1, 254.2, 254.8, 254.9, 254, 254.1; 215/387, 388, DIG. 7; 206/217
See application file for complete search history.

(56) References Cited

U.S. PATENT DOCUMENTS

| | | | | |
|---|---|---|---|---|
| 6,609,624 | B2 * | 8/2003 | Goto et al. | 220/259.1 |
| 7,143,958 | B1 * | 12/2006 | Dorney | 239/289 |
| 2004/0065635 | A1 * | 4/2004 | Turnbough | 215/11.1 |
| 2005/0115967 | A1 * | 6/2005 | Conaway | 220/254.1 |
| 2012/0160851 | A1 * | 6/2012 | Chiang | 220/360 |

* cited by examiner

*Primary Examiner* — Mickey Yu
*Assistant Examiner* — Kareen Rush
(74) *Attorney, Agent, or Firm* — Mary Terry

(57) ABSTRACT

A device for eating and drinking is disclosed. The device includes a substantially cylindrical container for holding a liquid and a substantially bowl-shaped element having a tubular element extending through a central axis of the bowl-shaped element, wherein a lumen of the tubular element fits securely around a top portion of the cylindrical container.

14 Claims, 5 Drawing Sheets

100

100

100

BOWL AND CUP COMBINATION APPARATUS

CROSS-REFERENCE TO RELATED APPLICATIONS

This utility patent application claims priority to provisional patent application No. 61/460,297 filed on Dec. 30, 2011. The subject matter of provisional patent application No. 61/460,297 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of personal eating and drinking devices, and more particularly relates to the field of children's cups and bowls.

BACKGROUND OF THE INVENTION

Conventional personal eating and drinking devices, such as cups, bowls and plates, are usually designed such that the user is sitting at a table while eating and drinking. Consequently, personal eating and drinking devices are usually made to be picked up, used and then placed back down on the table, thereby freeing the user's hands to manipulate other eating devices. A user, for example, may have a cup of milk and a plate of cookies on the table in front of him and use both items at separate times.

In cases where the user is sitting on a couch or in the back seat of the car, however, the method in which personal eating and drinking devices are used changes. The user no longer picks up the device, uses it and places it back down. When sitting on a couch or in the backseat of a car, the user must often keep the personal eating or drinking device in his hand indefinitely, thereby occupying his hand and eliminating its use elsewhere. A user, for example, may have a cup of milk in one hand and a plate of cookies in the other hand. Although the user can drink his cup of milk, the user would not have a free hand to pick up a cookie and place it in his mouth. This poses a problem when using conventional personal eating and drinking devices in unconventional places or positions, such as sitting on a couch or the backseat of a car. This problem is further compounded when the user is a child and there is an increased risk of spillage, dropping the personal eating or drinking device or tilting it at an angle.

Consequently, a need exists to overcome the problems with the prior art as discussed above, and particularly for a more efficient and easy-to-use personal eating and drinking device for use in unconventional places or positions.

SUMMARY OF THE INVENTION

Briefly, according to an embodiment of the present invention, a device for eating and drinking is disclosed. The device includes a substantially cylindrical container for holding a liquid and a substantially bowl-shaped element having a tubular element extending through a central axis of the bowl-shaped element, wherein a lumen of the tubular element fits securely around a top portion of the cylindrical container.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings.

DETAILED DESCRIPTION

The present invention solves the problems with the prior art by providing an eating and drinking device that combines a cup and a bowl. The cup and bowl combination allows a user to hold a cup including a liquid and a bowl holding a solid food in one hand, thereby freeing the other hand to pick up the solid food and eat it. The present invention is advantageous since it allows a user to hold a liquid and a solid with one hand when in an unconventional place or position, such as sitting on a couch or the backseat of a car. The present invention is further advantageous since it facilitates eating and drinking for a child by providing a covered "sippy cup" device, where there is an increased risk of spillage, dropping the personal eating or drinking device or tilting it at an angle. Finally, the present invention is further advantageous since it is manufactured using a minimum number of pieces and moving parts, which facilitates repair and results in a lower probability of failure or malfunction.

Figure 1:
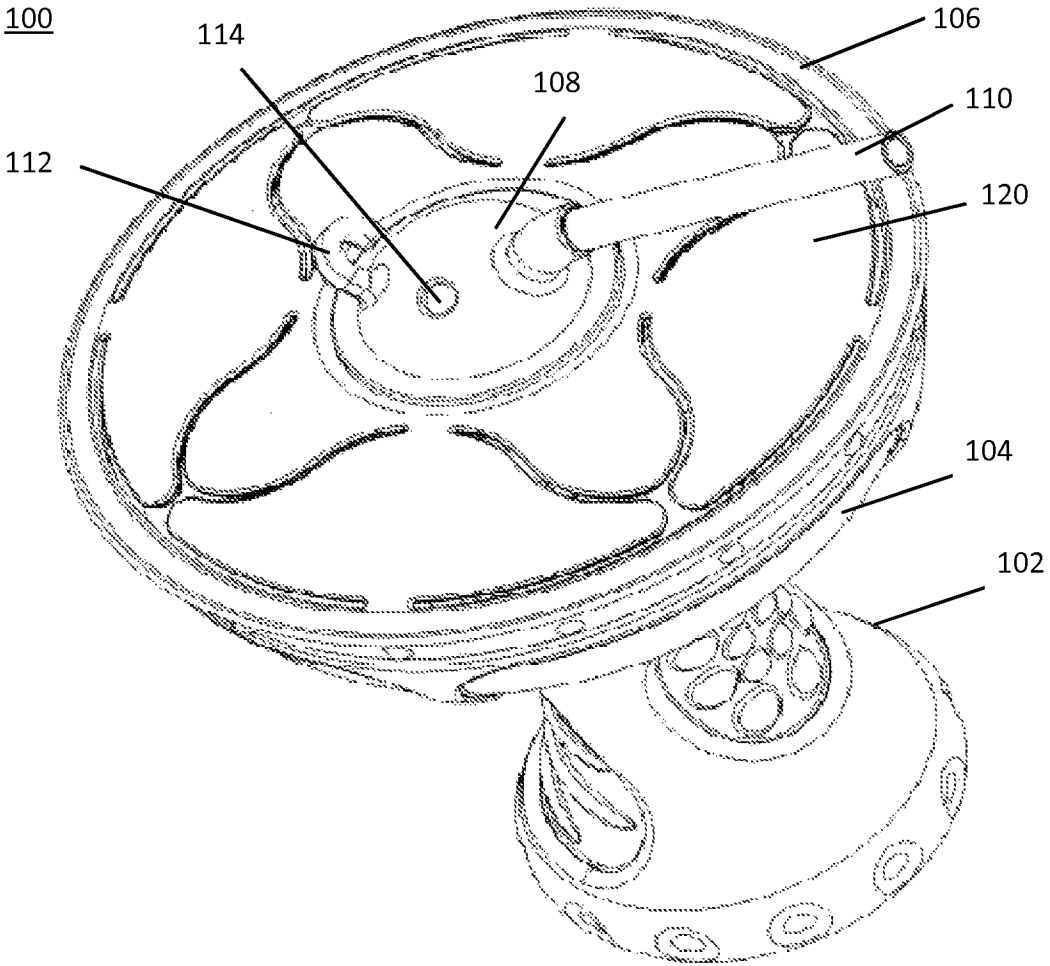
FIG. 1 is an illustration of a perspective view of the personal eating and drinking device, according to an embodiment of the present invention.

FIG. 1 is an illustration of a perspective view of the personal eating and drinking device 100, according to an embodiment of the present invention. FIG. 1 shows a substantially cylindrical container 102 for holding a liquid, wherein the container may be composed of a flexible, dishwasher-safe material such as plastic or a plastic composition. The exterior surface of the cylindrical container 102 may comprise a concave shape for facilitating gripping by a user's hand. The exterior surface of the cylindrical container may further comprise a textured surface, such as spherical protrusions, bump and ridges, for facilitating gripping by a user's hand. The textures may be composed of a rubber material such as silicone rubber.

FIG. 1 also shows a bowl-shaped element 104 that extends around an exterior circumference of a top portion of the cylindrical container 102. The cylindrical container 102 and the bowl-shaped element 104 may be integrally formed of the same material. FIG. 1 further shows a circular-shaped cover 106 for the bowl-shaped element 104 that covers a top opening of the bowl-shaped element 104. The cover 106 may include one or more retractable flaps 120 that can bend inwards and outwards to allow a user's finger access to the interior of the bowl-shaped element 104 while retaining the solid food within the bowl-shaped element 104. The cover 106 includes at least four Y-shaped openings equally spaced around the surface of the cover 106, wherein the openings outline the various retractable flaps 120.

Figure 4:
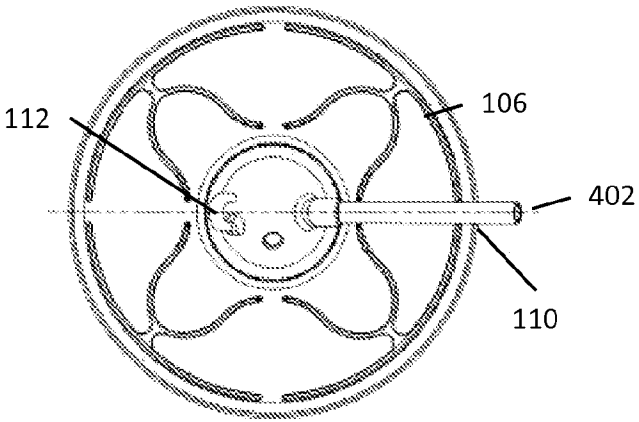
FIG. 4 is an illustration of a top view of the personal eating and drinking device of FIG. 1.

FIG. 1 also shows a cap 108 for covering top opening of the cylindrical element 102. The cap 108 may include a straw 110 that extends from the exterior of the cap 108 into the interior volume of the cylindrical container 102. The cap 108 may also include a hook 112 located on an exterior of the cap 108 behind the straw 110, such that the straw 110 may be bent and secured under the hook 112 such that the lumen of the straw 110 is blocked and no longer allow liquid to travel through it. This action seals off the interior of the cylindrical element 102, thereby eliminating spillage of the liquid inside the cylindrical element 102 (also see FIG. 4). Lastly, the cap 108 may also include a one-way vent 114 that allows air to enter the interior of the cylindrical element 102 while restricting liquid inside the cylindrical element 102 to exit the vent 114. This feature allows a user to sip or drink the liquid inside the cylindrical element 102 through the straw while allowing air to enter the interior of the cylindrical element 102 to equalize the pressure within the cylindrical element 102.

The cover 106, cap 108 and straw 110 may be composed of a flexible, dishwasher-safe material such as rubber or a rubber composition.

Figure 2:
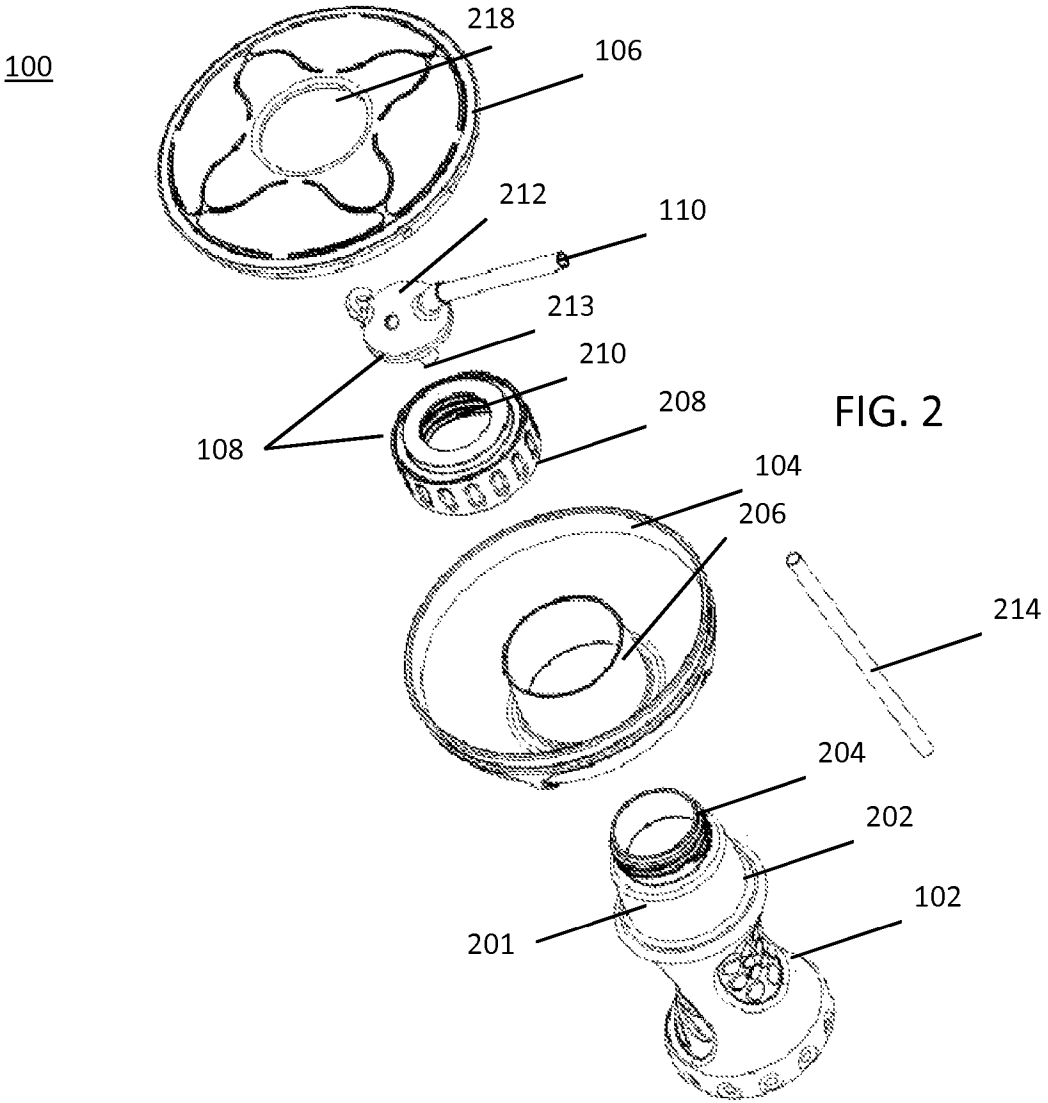
FIG. 2 is an illustration of a perspective view of the personal eating and drinking device of FIG. 1 in a disassembled state.
Figure 3:
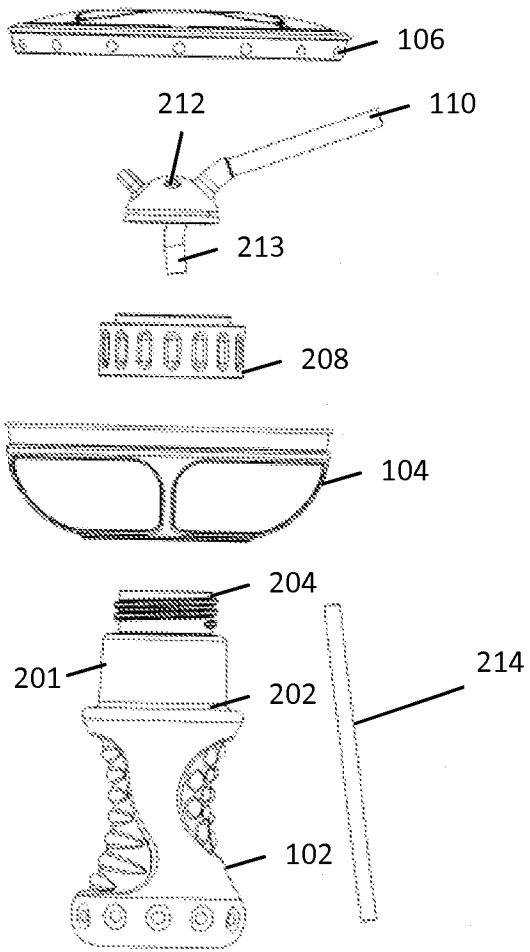
FIG. 3 is an illustration of a side view of the personal eating and drinking device of FIG. 1 in a disassembled state.

FIG. 2 is an illustration of a perspective view of the personal eating and drinking device 100 of FIG. 1 in a disassembled state. FIG. 3 is an illustration of a side view of the personal eating and drinking device 100 of FIG. 1 in a disassembled state.

Figure 5:
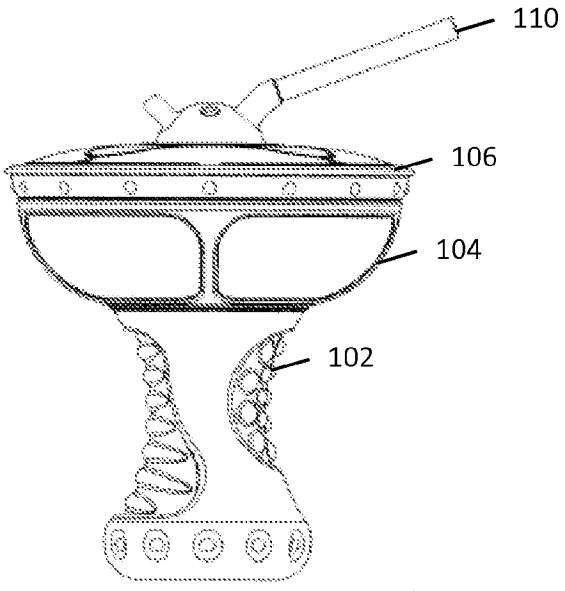
FIG. 5 is an illustration of a side view of the personal eating and drinking device of FIG. 1.

FIGS. 2 and 3 show that a top portion 201 of the cylindrical container 102 comprises a substantially cylindrical shape. Also, the base of the top portion 201 of the cylindrical container 102 comprises a lip 202 that protrudes from the exterior surface of the cylindrical container 102, such that the bowl-shaped element 104 rests on top of the lip 202 (also see FIG. 5). Further, the exterior surface of the top portion 201 of the cylindrical container 102 includes a threaded element 204. FIG. 2 also shows that bowl-shaped element 104 includes a tubular element 206 extending through a central axis of the bowl-shaped element 104, wherein a lumen of the tubular element 206 fits securely around a top portion 201 of the cylindrical container 102. Note that when the tubular element 206 is placed around a top portion 201 of the cylindrical container 102, the threaded element 204 extends over the top of the tubular element 206 (see FIG. 6).

FIGS. 2 and 3 further show that cap 108 comprises a collar 208 that is coupled to a lid 212. The interior surface of the collar 208 comprises a threaded element 210 that is coupled to the threaded element 204 of the cylindrical container 102. FIGS. 2 and 3 further show that straw 110 comprises a removable lower portion 214 that is coupled to a stub 213 using a friction fit. The removable nature of the lower portion 214 facilitates cleaning of the device 100. Note that FIG. 6 also shows straw 214 extending into the bottom interior portion of the container 102 at an angle, so as to facilitate reaching liquid that has pooled in the corners of the interior portion of the container 102. FIG. 2 also shows that cover 106 includes an orifice 218 in the center-point or mid-point of the cover 106, through which the cap 108 and lip 212 may extend.

In another embodiment of the present invention, the bowl-shaped element 104 is coupled to the cylindrical container 102 using threaded elements, in the same way that collar 208 has a threaded element 210 that is coupled to the threaded element 204 of the cylindrical container 102.

Figure 6:
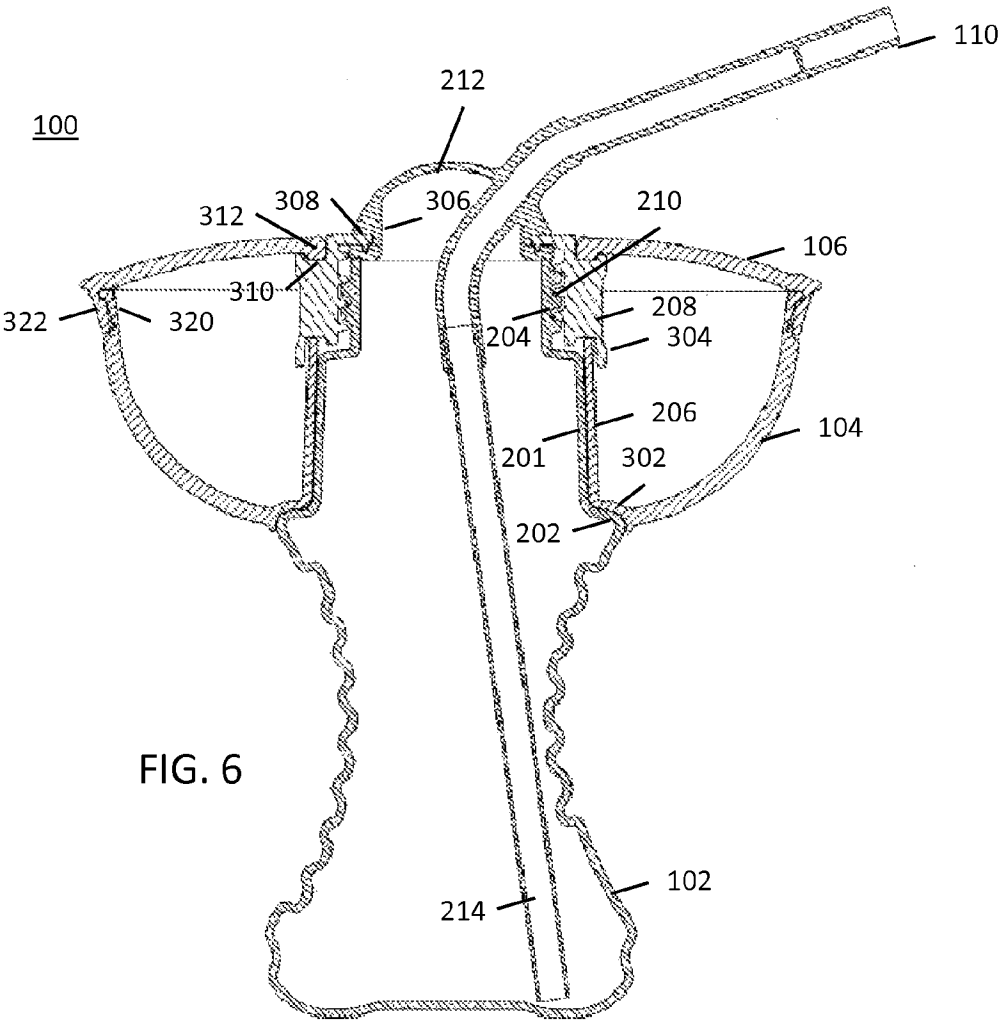
FIG. 6 is an illustration of a cross-sectional side view of the personal eating and drinking device of FIG. 1.

FIG. 6 is an illustration of a cross-sectional side view of the personal eating and drinking device 100 of FIG. 1. FIG. 6 shows a cross section of device 100 along a transverse plane designated as line 402 of FIG. 4. FIG. 6 shows that tubular element 206 of bowl-shaped element 104 fits securely around the top portion 201 of cylindrical container 102. FIG. 6 also shows that when bowl-shaped element 104 is placed on the top portion 201 of cylindrical container 102, the bowl-shaped element 104 rests on top of the protruding lip 202. FIG. 6 further shows that bowl-shaped element 104 may contain a concave-formed element 302 that is conformed to the concave-formed lip 202. Note also that when bowl-shaped element 104 is placed on the top portion 201 of cylindrical container 102, the threaded element 204 of the cylindrical container 102 extends past the top of the bowl-shaped element 104. This allows the threaded element 210 of collar 208 to be coupled to the threaded element 204 of the cylindrical container 102, thereby securing the bowl-shaped element 104 in place and preventing the bowl-shaped element 104 from moving upwards and off of the cylindrical container 102. FIG. 6 further shows that collar 208 includes an eave 304 that overhangs the top the tubular element 206, so as to further secure the bowl-shaped element 104 in place and preventing it from moving.

FIG. 6 further shows how lid 212 is coupled to the collar 208. Lid 212 includes a gutter 306 that extends around the circumference of its lower brim. A top ring 308 of the collar 208 fits securely within the gutter 306 so as to secure the lid 212 to the collar 208. This feature also renders the lid 212 removable from the collar 208, thereby facilitating cleaning of the device 100. Also, FIG. 6 shows a top-facing gutter 310 located on a top-facing surface of the collar 208. The cover 106 includes a protruding ridge 312 along the interior surface of the inside brim of orifice 218 (see FIG. 2), wherein the ridge 312 fits securely within the top-facing gutter 310 of the collar 208. This feature serves to better secure the cover 106 to the collar 208 and impede its movement. Lastly, FIG. 6 shows an outward-facing gutter 320 located on an outward facing-facing surface of the bowl 102. The cover 106 includes a protruding ring 322 along the interior surface of the inside brim of the cover 106, wherein the ring 322 fits securely within the outward-facing gutter 320 of the cover 106. This feature serves to better secure the cover 106 to the bowl 102 and impede its movement.

One or more of the elements of the device 100 may be manufactured from a plastic or rubber compound using any variety of processes, such as injection molding, fusible core injection molding and thermoforming.

Injection molding is a manufacturing technique for making parts from thermoplastic material in production. Molten plastic is injected at high pressure into a mold, which is the inverse of the product's shape. After a product is designed by an industrial designer, molds are made by a mold-maker from metal, usually either steel or aluminum, and precision-machined to form the features of the desired part. Injection molding is widely used for manufacturing a variety of parts and is the most common method of plastic production. The most commonly used thermoplastic materials are polystyrene, ABS or acrylonitrile butadiene styrene, nylon, polypropylene, polyethylene, and polyvinyl chloride or PVC.

Injection molding machines, also known as presses, hold the molds in which the components are shaped. Presses are rated by tonnage, which expresses the amount of clamping force that the machine can generate. This pressure keeps the mould closed during the injection process. Molds separate into at least two halves (called the core and the cavity) to permit the plastic part to be extracted. In general, the shape of a part must not cause it to be locked into the mould. For example, sides of objects typically cannot be parallel with the direction of draw (the direction in which the core and cavity separate from each other). They are angled slightly. Pins are the most popular method of removal from the core, but air ejection, and stripper plates can also be used depending on the application. Most ejection plates are found on the moving half of the tool, but they can be placed on the fixed half.

Molds are built through two main methods: standard machining and EDM machining. Standard machining, in its conventional form, has historically been the method of building injection molds. With technological development, computer numerical control (CNC) machining became the predominant means of making more complex molds with more accurate mold details in less time than traditional methods.

The electrical discharge machining (EDM) or spark erosion process has become widely used in mold making. EDM is a simple process in which a shaped electrode, usually made of copper or graphite, is very slowly lowered onto the mould surface (over a period of many hours), which is immersed in paraffin oil. A voltage applied between tool and mould causes erosion of the mould surface in the inverse shape of the electrode.

Fusible core injection molding or lost core injection molding is a specialized plastic injection molding process. It is used in the manufacture of molded components with cavities or undercuts, which would not be possible with tools having demoldable cores. The process consists of three essential steps. First, a core consisting of a low melting point metal is poured in the shape of the cavity specified for the molded component. This is inserted into the injection mold in the second step and injected with plastic. Molded component and core are both demolded and, in the third step, immersed in a heated bath to melt out the core. The bath temperature is selected to be somewhat higher than that of the core alloy's melting point, but not so that the injected part would be damaged. Induction heating of the core metal in the heated bath reduces the melt out time to a few minutes. Liquid core metal collects on the bottom of the heated bath and is usable for a new core.

Thermoforming is a manufacturing process for thermoplastic sheet or film. The sheet or film is heated between infrared, natural gas, or other heaters to its forming temperature. Then it is stretched over or into a temperature-controlled, single-surface mold. Cast or machined aluminum is the most common mold material, although epoxy and wood tooling are sometime used for low volume production. The sheet is held against the mold surface unit until cooled. The formed part is then trimmed from the sheet. The trimmed material is usually reground, mixed with virgin plastic, and reprocessed into a usable sheet. There are several categories of thermoforming, including vacuum forming, pressure forming, twin-sheet forming, drape forming, free blowing, and simple sheet bending.

In one embodiment of the present invention, one or more of the elements of device 100 may be manufactured from a material that is a solid color (or multiple solid colors), a transparent color (or multiple transparent colors) or may include a pattern or other series of multiple colors in a variety of selections. In another embodiment of the present invention, one or more of the elements of device 100 may include graphics, designs, logos, pictures, or any images that can be applied to the surfaces. The graphics may be embedded in the material comprising the device 100 or the graphics may be stamped, painted, stenciled, laser etched, printed, engraved or silk-screened onto the exterior or interior surfaces of the device 100.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

We claim:

1. A device for eating and drinking, comprising:

a substantially cylindrical container for holding a liquid, wherein an exterior surface of the cylindrical container comprises a concave shape and a textured surface for facilitating gripping by a user's hand;

a substantially bowl-shaped element having a tubular element extending through a central axis of the bowl-shaped element, wherein a lumen of the tubular element fits securely around a top portion of the cylindrical container, wherein a base of the top portion of the cylindrical container comprises a lip that protrudes from the exterior surface of the cylindrical container, such that the bowl-shaped element rests on top of the lip, and wherein the exterior surface of the top portion of the cylindrical container includes a threaded element that extends above a top of the tubular element of the bowl-shaped element; and a cap that is coupled to a top portion of the cylindrical container, thereby restricting the bowl-shaped element from moving upwards.

2. The device of claim 1, wherein an interior surface of the cap comprises a threaded element that is coupled to the threaded element of the cylindrical container.

3. The device of claim 2, wherein the cap further comprises a straw that extends from the exterior of the cap to the interior of the cylindrical container.

4. The device of claim 3, wherein the cap further comprises a hook located on an exterior of the cap behind the straw, such that the straw may be bent and secured under the hook.

5. The device of claim 4, further comprising a circular-shaped cover for the bowl-shaped element that covers a top opening of the bowl-shaped element.

6. The device of claim 5, wherein the circular-shaped cover for the bowl-shaped element includes an orifice in its midpoint, wherein the cap and extends through the orifice.

7. The device of claim 6, wherein the circular-shaped cover for the bowl-shaped element includes one or more retractable flaps that allow access to an interior of the bowl-shaped element.

8. A device for eating and drinking, comprising:

a substantially cylindrical container for holding a liquid;

a substantially bowl-shaped element having a tubular element extending through a central axis of the bowl-shaped element, wherein a lumen of the tubular element fits securely around a top portion of the cylindrical container;

a cap that is coupled to a top portion of the cylindrical container, thereby restricting the bowl-shaped element from moving upwards; and a circular-shaped cover for the bowl-shaped element that covers a top opening of the bowl-shaped element.

9. The device of claim 8, wherein an exterior surface of the cylindrical container comprises a concave shape for facilitating gripping by a user's hand.

10. The device of claim 9, wherein an exterior surface of the cylindrical container comprises a textured surface for facilitating gripping by a user's hand.

11. The device of claim 10, wherein a base of the top portion of the cylindrical container comprises a lip that protrudes from the exterior surface of the cylindrical container, such that the bowl-shaped element rests on top of the lip.

12. The device of claim 11, wherein the exterior surface of the top portion of the cylindrical container includes a threaded element that extends above a top of the tubular element of the bowl-shaped element.

13. The device of claim 12, wherein an interior surface of the cap comprises a threaded element that is coupled to the threaded element of the cylindrical container.

14. The device of claim 13, wherein the cap further comprises a straw that extends from the exterior of the cap to the interior of the cylindrical container.

* * * * *